US009242277B2

(12) United States Patent
Sato

(10) Patent No.: US 9,242,277 B2
(45) Date of Patent: Jan. 26, 2016

(54) MAINTENANCE DEVICE, LIQUID EJECTING APPARATUS, AND MAINTENANCE METHOD

(71) Applicant: SEIKO EPSON CORPORATION, Tokyo (JP)

(72) Inventor: Kazuhiko Sato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/606,635

(22) Filed: Jan. 27, 2015

(65) Prior Publication Data

US 2015/0231887 A1 Aug. 20, 2015

(30) Foreign Application Priority Data

Feb. 14, 2014 (JP) ..... 2014-027027

(51) Int. Cl.
*B41J 2/165* (2006.01)
*B08B 1/00* (2006.01)

(52) U.S. Cl.
CPC ..... *B08B 1/005* (2013.01); *B08B 1/006* (2013.01); *B41J 2/16538* (2013.01); *B41J 2/16541* (2013.01)

(58) Field of Classification Search
CPC ..... B41J 2/16547; B41J 2/16538; B41J 2/16541; B41J 2/16585; B41J 2/16588
USPC ..... 347/22, 32, 33
See application file for complete search history.

(56) References Cited

U.S. PATENT DOCUMENTS 6,164,754 A * 12/2000 Ide et al. ..... 347/33
7,703,880 B2 * 4/2010 Tanaka et al. ..... 347/33

FOREIGN PATENT DOCUMENTS

| | | |
|---|---|---|
| JP | 2000-177140 | 6/2000 |
| JP | 2004-122619 | 4/2004 |
| JP | 2011-056889 | 3/2011 |
| JP | 2013-188965 | 9/2013 |

* cited by examiner

*Primary Examiner* — An Do
(74) *Attorney, Agent, or Firm* — Workman Nydegger

(57) ABSTRACT

Provided is a maintenance device including a wiper which wipes attached material on a liquid ejecting portion, a first cleaner which cleans the wiper to which the attached material adheres during wiping, and a second cleaner which cleans the first cleaner to which the attached material adheres during cleaning.

11 Claims, 10 Drawing Sheets

MAINTENANCE DEVICE, LIQUID EJECTING APPARATUS, AND MAINTENANCE METHOD

CROSS-REFERENCE TO RELATED APPLICATIONS

The entire disclosure of Japanese Patent Application No. 2014-027027, filed Feb. 14, 2014, is expressly incorporated by reference.

BACKGROUND

1. Technical Field

The present invention relates to a maintenance device, a liquid ejecting apparatus, and a maintenance method.

2. Related Art

An ink jet type printer including a liquid ejecting head which performs printing in such a manner that the liquid ejecting head ejects ink droplets onto a medium, such as a paper sheet, a wiper which wipes ink adhering to the liquid ejecting head, and a wiper cleaner which absorbs and removes the ink adhering to the wiper is known as an example of a liquid ejecting apparatus (for example, JP-A-2013-188965).

The wiper cleaner described above includes an ink absorbing material capable of absorbing ink and removes the ink adhering to the wiper, in an absorbing manner. Accordingly, when the ink absorbing material absorbs the ink by the amount corresponding to the absorption capacity thereof, the ink absorbing material cannot absorb more ink. Then, when the wiper comes into contact with the ink absorbing material in a state where the ink absorbing material cannot absorb more ink, the ink held in the ink absorbing material adheres to the wiper. As a result, there is a problem in that the wiper becomes contaminated, contrary to expectations.

Such a problem is not limited to a printer which performs printing in such a manner that ink droplets are ejected but is generally shared by a maintenance device having a function of cleaning the wiper for wiping a target object, a liquid ejecting apparatus, and a maintenance method.

SUMMARY

An advantage of some aspects of the invention is to provide a maintenance device capable of preventing a decrease in a function of cleaning a wiper, a liquid ejecting apparatus, and a maintenance method.

Hereinafter, means of the invention and operational effects thereof will be described.

According to an aspect of the invention, there is provided a maintenance device including a wiper which wipes attached material on a target object, a first cleaner which cleans the wiper to which the attached material adheres during wiping, and a second cleaner which cleans the first cleaner to which the attached material adheres during cleaning.

In this case, the first cleaner cleans off the attached material on the wiper, and then the second cleaner cleans the first cleaner to which the attached material adheres during cleaning. Thus, a decrease in the function of cleaning the first cleaner for cleaning the wiper can be prevented. The target object is wiped using the wiper which is cleaned by the first cleaner and does not have attached material remaining thereon, and thus adhering of remaining attached material to the target object is prevented. As a result, the target object can be always maintained in a clean state.

In the maintenance device, it is preferable that the wiper and the first cleaner relatively move in a state where tip end sides thereof are in contact with each other and base end sides are separated and the first cleaner scrape off the attached material on the wiper.

In this case, the wiper and the first cleaner relatively move in a state where the tip end side of the wiper is in contact with the tip end side of the first cleaner. As a result, the first cleaner can effectively scrape off the attached material on the wiper.

In the maintenance device, it is preferable that the first cleaner pivot in a direction in which the tip end thereof moves vertically upward, in a state where the tip end is located below the base end in the vertical direction, and the first cleaner clean the wiper.

In this case, the first cleaner pivots in a direction in which the tip end moves to the vertically upper side. Thus, the wiper can be cleaned from the vertically lower side to the upper side thereof. As a result, the attached material can be moved from the wiper to the first cleaner, in a state where dripping of the attached material on the wiper is prevented.

In the maintenance device, it is preferable that the first cleaner have a scraping surface for scraping off the attached material on the wiper. In addition, it is preferable that the second cleaner have a holding surface on a tip end thereof. Furthermore, it is preferable that the first cleaner and the second cleaner relatively move in a state where the holding surface is in contact with the scraping surface and the holding surface scrape off the attached material on the scraping surface.

In this case, when the first cleaner moves relative to the second cleaner, the holding surface provided in the tip end of the second cleaner comes into contact with the scraping surface. As a result, the edge portion of the holding surface can effectively scrape off the attached material on the scraping surface.

In the maintenance device, it is preferable that the scraping surface extend from the tip end of the first cleaner to a base end side. In addition, it is preferable that the first cleaner and the second cleaner relatively move in a direction in which the tip ends thereof are aligned, in a state where the holding surface is disposed on the vertically upper side of the scraping surface.

In this case, when the first cleaner moves relative to the second cleaner, the holding surface is disposed on the vertically upper side of the scraping surface. Thus, when the holding surface scrapes off the attached material on the scraping surface, dripping of the attached material is prevented. Furthermore, when the tip ends of both the first cleaner and the second cleaner are aligned through the relative movement, the attached material can be removed from the scraping surface of the first cleaner.

In the maintenance device, it is preferable that the maintenance device further include a third cleaner which comes into contact with the holding surface of the second cleaner and recovers the attached material on the holding surface. In addition, it is preferable that a tip end surface intersecting the scraping surface be provided in the tip end of the first cleaner, such that, when the relative movement between the first cleaner and the second cleaner is finished, the tip end surface and the holding surface form one surface.

In this case, when the relative movement between the first cleaner and the second cleaner is finished, the attached material moved from the scraping surface adheres to the holding surface of the second cleaner. In this case, both the holding surface and the tip end surface form one surface. Thus, when the third cleaner comes into contact with the holding surface and recovers the attached material, a hindrance to the recovery movement of the third cleaner, resulting from the contact between the third cleaner and, for example, the scraping surface of the first cleaner, is prevented.

In the maintenance device, it is preferable that the third cleaner have a recovery surface extending from a tip end of the third cleaner to a base end side. In addition, it is preferable that the recovery surface of the third cleaner come into contact with the holding surface of the second cleaner in a pivoting state and the third cleaner recover the attached material on the holding surface. Furthermore, when the relative movement between the first cleaner and the second cleaner is finished, the tip end surface and the holding surface form a curved surface.

In this case, when the relative movement between the first cleaner and the second cleaner is finished, both the tip end surface and the holding surface form a curved surface. As a result, the tip end portion of the third cleaner can effectively scrape off the attached material on the holding surface of the second cleaner in a pivoting state.

In the maintenance device, it is preferable that the maintenance device further include an accommodation portion which can accommodate the attached material recovered by the third cleaner. In addition, it is preferable that the accommodation portion be disposed below the recovery surface in the vertical direction.

In this case, the accommodation portion is disposed below the recovery surface of the third cleaner in the vertical direction. As a result, the attached material dripping from the recovery surface of the third cleaner can be accommodated in the accommodation portion.

In the maintenance device, it is preferable that, in a pivot-axial direction of the second cleaner, the length of the scraping surface of the first cleaner or the holding surface of the second cleaner be longer than that of the tip end of the wiper and shorter than that of the recovery surface of the third cleaner.

In this case, in the pivot-axial direction of the second cleaner, the length of the scraping surface of the first cleaner or the holding surface of the second cleaner is longer than that of the tip end of the wiper. Thus, the first cleaner can scrape off the attached material on the wiper, without attached material remaining. In addition, the second cleaner can scrape off the attached material on the first cleaner, without attached material remaining. Furthermore, in the pivot axial direction of the second cleaner, the length of the recovery surface of the third cleaner is longer than that of the holding surface of the second cleaner. Thus, the third cleaner can scrape off the attached material on the second cleaner, without attached material remaining. In other words, since the target object is wiped using the wiper which is cleaned by the first cleaner and does not have attached material remaining thereon, adhering of remaining attached material to the target object is prevented. As a result, the target object can be always maintained in a clean state.

According to another aspect of the invention, there is provided a liquid ejecting apparatus including a liquid ejecting portion which can eject liquid, a wiper which wipes liquid adhering to the liquid ejecting portion, a first cleaner which cleans the wiper, and a second cleaner which cleans the first cleaner to which the liquid adheres during cleaning.

In this case, the first cleaner cleans off the liquid adhering to the wiper, and then the second cleaner cleans the first cleaner to which the liquid adheres during cleaning. Thus, a decrease in function of cleaning the wiper can be prevented. In addition, since a clean state of the wiper can be maintained by cleaning, a decrease in wiping function of the wiper, relative to the liquid ejecting portion, can be prevented.

According to still another aspect of the invention, there is provided a maintenance method including wiping attached material on a target object, using a wiper, cleaning the wiper to which the attached material adheres during wiping, using a first cleaner, and cleaning the first cleaner to which the attached material adheres during cleaning, using a second cleaner.

In this case, the same operational effects as those of the maintenance device described above can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the liquid ejecting apparatus will be described with reference to the accompanying drawings.

A liquid ejecting apparatus is an ink jet type printer which performs printing in such a manner that ink as an example of a liquid is ejected onto a medium, such as a paper sheet.

Figure 1:
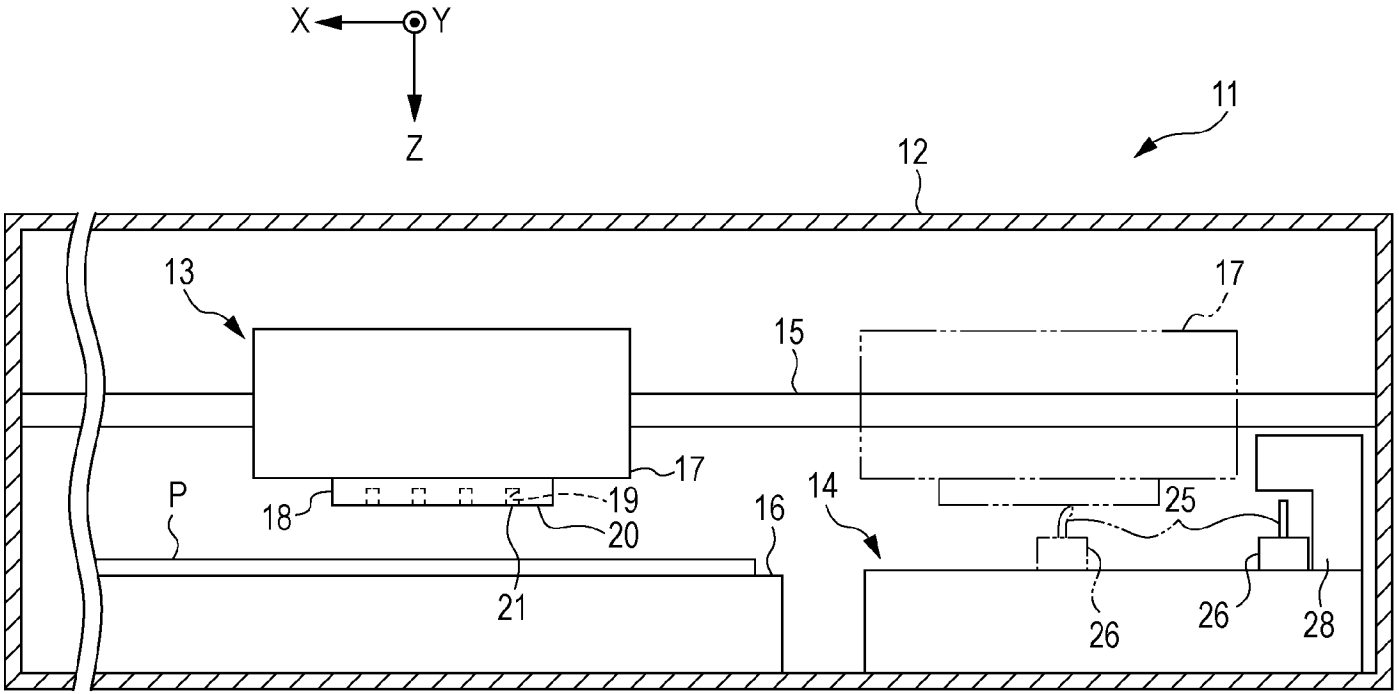
FIG. 1 is a schematic cross-sectional view illustrating the configuration of a liquid ejecting apparatus of an embodiment.

A liquid ejecting apparatus 11 includes a case body portion 12, recording portion 13, and a maintenance device 14, as illustrated in FIG. 1. The recording portion 13 and the maintenance device 14 are accommodated in the case body portion 12. Both a guide shaft 15 extending in the longitudinal direction (which is a right-left direction in FIG. 1) of the case body portion 12 and a support base 16 for supporting a medium P are accommodated in the case body portion 12. The medium P is transported in a transporting direction Y (which is a direction directed from a paper surface to a front side in FIG. 1), on the support base 16 by a transporting mechanism (not illustrated).

The recording portion 13 includes a carriage 17 and a liquid ejecting portion 18. The carriage 17 reciprocates along the guide shaft 15. The liquid ejecting portion 18 is held in the carriage 17. In this embodiment, one end side (which is a right end side in FIG. 1) in the longitudinal direction is referred to as a home side and the other end side (which is a left end side in FIG. 1) in the longitudinal direction is referred to as an opposite home side. A direction (that is, a direction directed to a left side in FIG. 1) directed from the home side to the opposite home side is set to a movement direction X of the carriage 17. In this embodiment, the movement direction X is a direction (preferably, the perpendicular direction) intersecting both a transporting direction Y and a gravity direction Z (which is a direction directed to a vertically lower side).

Nozzles 19 through which droplets of liquid are ejected are formed in the liquid ejecting portion 18. In addition, the liquid ejecting portion 18 has an opening surface 20 in which the nozzles 19 are open. In other words, ejection ports 21 constituted by openings of the nozzles 19 through which the liquid can be ejected are formed in the liquid ejecting portion 18. Any number can be selected as the number of nozzles 19 in the liquid ejecting portion 18.

When the carriage 17 reciprocates in the movement direction X, the liquid ejecting portion 18 performs printing in such a manner that the liquid ejecting portion 18 ejects liquid droplets onto the medium P supported by the support base 16. When printing is not being performed or power is turned off, the liquid ejecting portion 18, along with the carriage 17, move to the home position which is located in an end portion on the home side in the movement direction X, and then maintains a standby state.

The maintenance device 14 is disposed at the position corresponding to the home position of the liquid ejecting portion 18. The maintenance device 14 includes a wiper 25 and a movement body 26. The wiper 25 wipes attached material, such as liquid and paper dust, on the liquid ejecting portion 18 as an example of a target object. The movement body 26 holds the wiper 25 and moves in the movement direction X.

When the carriage 17 is stopped at the home position, wiping of the attached material on the opening surface 20 is performed in such a manner that the wiper 25 comes into contact with the opening surface 20 in a state where the wiper 25, along with the movement body 26, moves to the opposite home side in the movement direction X, as illustrated by a two-dot chain line in FIG. 1.

When wiping is performed, it is preferable that the wiper 25 be arranged at the position at which a tip end portion of the wiper 25 and the opening surface 20 overlap each other in the vertical direction. In this case, the tip end portion of the wiper 25 comes into contact with the liquid ejecting portion 18 and the wiper 25 is elastically deformed, and thus the tip end portion of the wiper 25 is pressed to the opening surface 20. As a result, it is possible to more reliably scrape off the attached material on the opening surface 20.

Wiping may be performed in such a manner that the wiper 25 is stopped at a position which is located further to the opposite home side than the position of the liquid ejecting portion 18 stopped at the home position, and then the liquid ejecting portion 18 moves to the home side in a state where the opening surface 20 comes into contact with the tip end portion of the wiper 25.

The maintenance device 14 includes a cleaning mechanism 29 (see FIG. 2) for cleaning the wiper 25. The cleaning mechanism 29 is held in a frame body 28 (see FIGS. 2 and 5).

Figure 2:
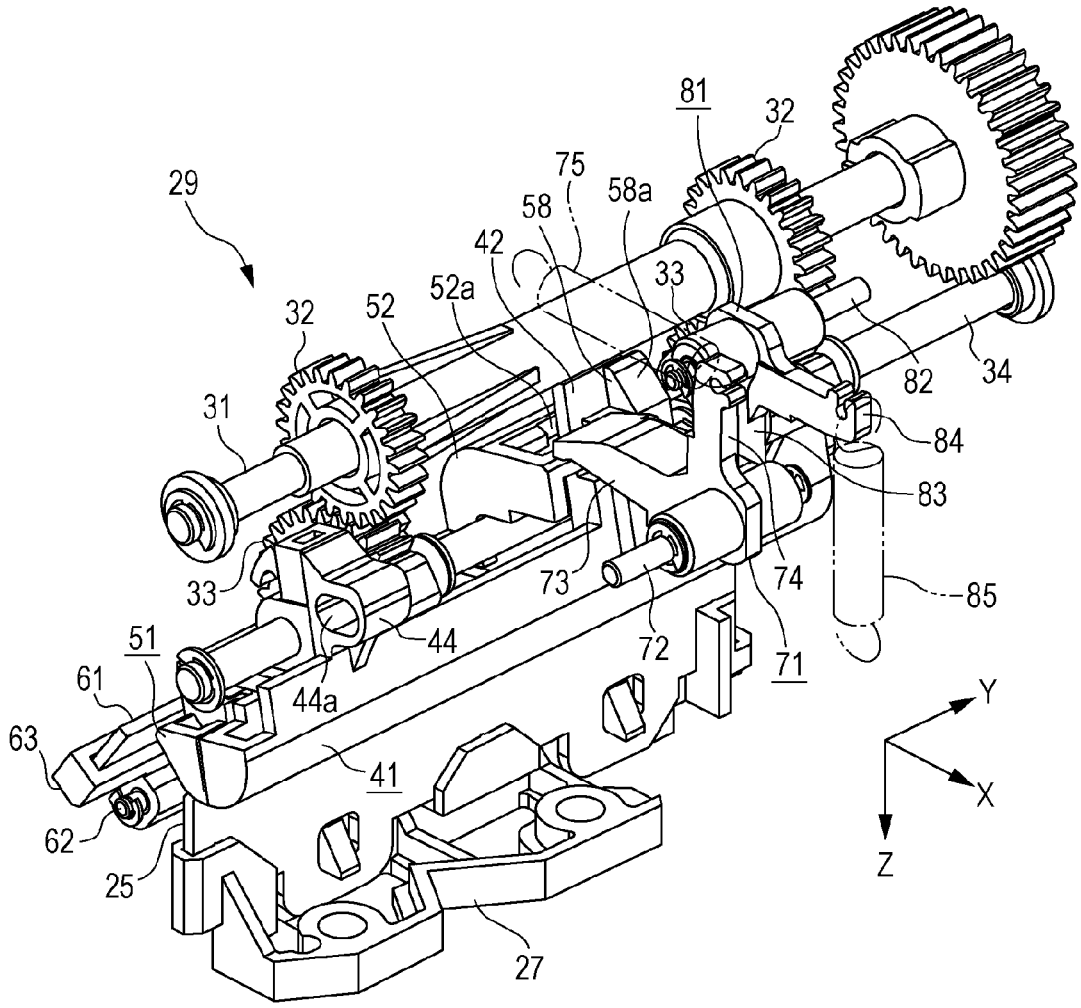
FIG. 2 is a perspective view illustrating a principal portion of a maintenance device of the embodiment.

The cleaning mechanism 29 includes a driving shaft 31 and a rotation shaft 34, as illustrated in FIG. 2. The driving shaft 31 is rotated by receiving a driving force from a driving source (not illustrated). The rotation shaft 34 is provided with driven gears 33 meshing with a pair of driving gears 32 mounted on the driving shaft 31. The cleaning mechanism 29 includes a first cleaner 41, a second cleaner 51, and a third cleaner 61. The first cleaner 41 wipes the wiper 25. The second cleaner 51 cleans the first cleaner 41 in a state where the attached material, such as liquid, adheres thereto during cleaning. The third cleaner 61 recovers the attached material on the second cleaner 51.

Both the first cleaner 41 and the second cleaner 51 are disposed above the wiper 25 in the vertical direction. An end of the first cleaner 41 or the second cleaner 51, which is directed to the vertically lower side, at an initial position of the cleaner illustrated in FIG. 2, is set to a tip end thereof. An end of the first cleaner 41 or the second cleaner 51, which is directed to the vertically upper side, is set to a base end thereof.

The second cleaner 51 is held on the rotation shaft 34. The first cleaner 41 is held by the second cleaner 51. When the rotation shaft 34 rotates, both the first cleaner 41 and the second cleaner 51 can pivot on the rotation shaft 34.

The cleaning mechanism 29 includes a first lever 71 and a second lever 81. When the first lever 71 is engaged with the first cleaner 41, the first lever 71 can regulate pivoting of both the first cleaner 41 and the second cleaner 51. When the second lever 81 is engaged with the second cleaner 51, the second lever 81 can regulate pivoting of both the first cleaner 41 and the second cleaner 51.

The first lever 71 can pivot on a first support shaft 72. The first lever 71 has a first arm portion 73 and a second arm portion 74, both of which extend from the first support shaft 72 in directions intersecting the axial direction of the first support shaft 72. When the tip end side of the second arm portion 74 is biased by a biasing member 75, the first arm portion 73 of the first lever 71 extends to the base end side of the first cleaner 41.

The second lever 81 can pivot on a second support shaft 82. The second lever 81 has a first arm portion 83 and a second arm portion 84, both of which extend from the second support shaft 82 in directions intersecting the axial direction of the second support shaft 82. When the tip end side of the second arm portion 84 is biased by a biasing member 85, the first arm portion 83 of the second lever 81 extends to the lower side in the vertical direction. The biasing members 75, 85 are constituted by elastic members, such as a coil spring.

In the base end portion of the second cleaner 51, an engagement portion 52 having an insertion hole 52*a* protrudes at the position corresponding to the first arm portion 73 of the first lever 71, in the axial direction (which is the direction parallel to the transporting direction Y) of the rotation shaft 34. In addition, in the engagement portion 52 of the second cleaner 51, a protrusion portion 58 having an inclined surface 58*a* protrudes at the position corresponding to the first arm portion 83 of the second lever 81, in the axial direction of the rotation shaft 34.

A protrusion portion 42 which can be inserted into the insertion hole 52*a* protrudes in the base end portion of the first cleaner 41. In the initial position illustrated in FIG. 2, the protrusion portion 42 of the first cleaner 41 is inserted through the insertion hole 52*a* and the tip end portion of the protrusion portion 42 protrudes from the insertion hole 52*a*.

Figure 3:
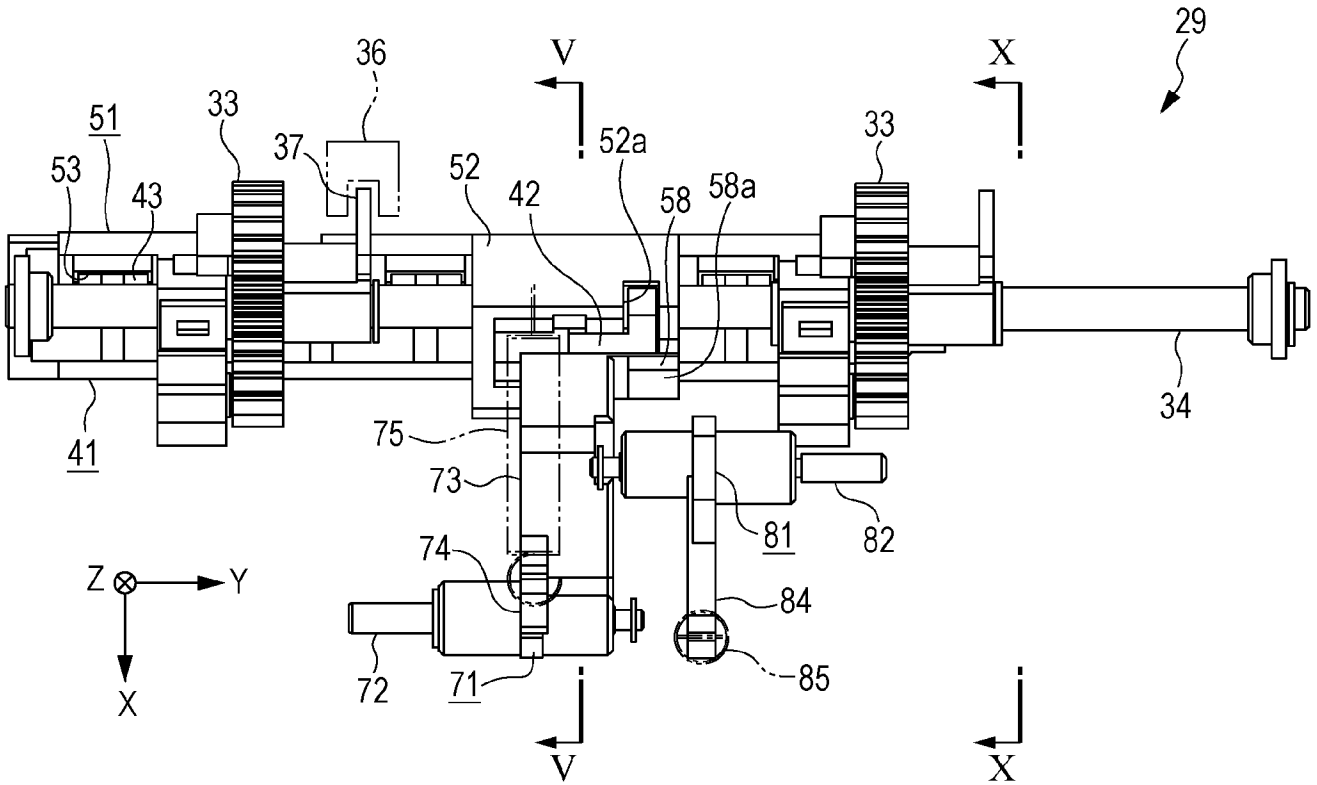
FIG. 3 is a top view of a cleaning mechanism.

In the axial direction (which is the right-left direction in FIG. 3) of the rotation shaft 34, both the first lever 71 and the second lever 81 are arranged in a portion between the two driven gears 33, as illustrated in FIG. 3. For clearly illustrating the configurations of both the first lever 71 and the second lever 81, the driving shaft 31, the driving gear 32, the wiper 25, the third cleaner 61, and the like are not illustrated in FIG. 3.

It is preferable that the cleaning mechanism 29 include a detecting unit 36 for detecting that the amount of rotation of the rotation shaft 34 has reached a predetermined threshold value. An example of the detection configuration is as follows. The detecting unit 36 includes an optical sensor having both a light emitting portion and a light receiving portion and a detection protrusion portion 37 is provided in the driven gear 33, as described in FIG. 3. In this case, the driven gear 33 rotates, along with the rotation shaft 34, from the initial position. That the amount of rotation of the rotation shaft 34 has reached the predetermined threshold value can be detected in such a manner that the detection protrusion portion 37 blocks a light beam emitted from the light emitting portion.

Figure 4:
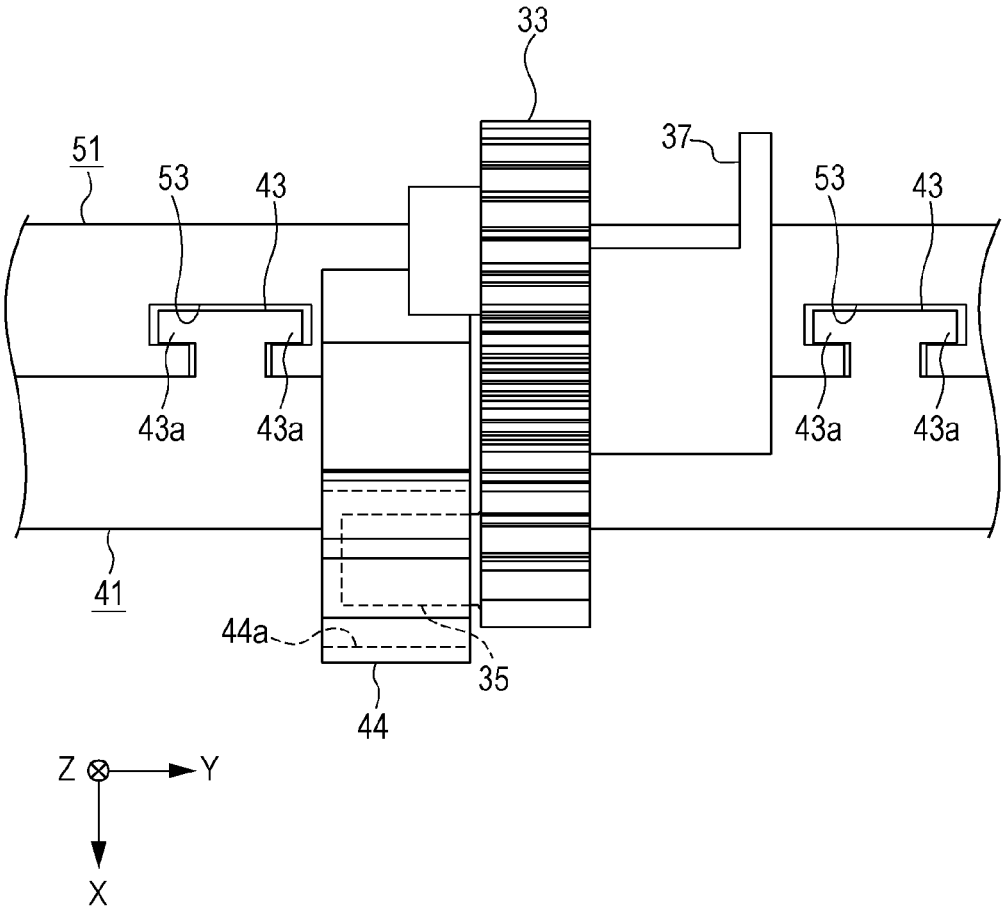
FIG. 4 is a schematic partially enlarged top view of FIG. 3.

An engagement convex portion 43 protruding to the second cleaner 51 is provided in the first cleaner 41 and a guiding groove 53 into which the engagement convex portion 43 can be inserted is provided in the second cleaner 51, as illustrated in FIG. 4. FIG. 4 is a schematic partially enlarged view of FIG. 3. For clearly illustrating the configurations of both the engagement convex portion 43 and the guiding groove 53, the rotation shaft 34 is not illustrated in FIG. 4.

The first cleaner 41 is held by the second cleaner 51, in a state where the first cleaner 41 can move, in a sliding manner, in a direction in which the first cleaner 41 moves away from the rotation shaft 34. Both the engagement convex portion 43 and the guiding groove 53 extend in the direction in which the first cleaner 41 moves in a sliding manner. Both the engagement convex portion 43 and the guiding groove 53 guide the slide-movement of the first cleaner 41.

It is preferable that a plurality of both the engagement convex portion 43 and the guiding groove 53 be provided in the axial direction of the rotation shaft 34. The reason for this is that, when the first cleaner 41 moves in a sliding manner, the first cleaner 41 is prevented from being inclined with respect to the axial direction. Furthermore, it is preferable that an engagement protrusion portion 43*a* protruding in the axial direction of the rotation shaft 34 be provided in the tip end side of the engagement convex portion 43 of the first cleaner 41. In this case, the engagement protrusion portion 43*a* engages with the guiding groove 53, and thus the first cleaner 41 is more reliably held by the second cleaner 51.

A pin 35 extending in the axial direction of the rotation shaft 34 protrudes in one end surface (which is the left end surface in FIG. 4) of the driven gear 33. Furthermore, an insertion portion 44 is provided in the base end portion of the first cleaner 41. An insertion hole 44*a* into which the pin 35 is inserted with a gap therebetween is formed in the insertion portion 44 of the first cleaner 41 (see FIGS. 2 and 4). When the pin 35 rotates along with the rotation shaft 34 and presses the first cleaner 41 via the insertion portion 44, the first cleaner 41 moves in a sliding manner with respect to the second cleaner 51, in a state where the engagement convex portion 43 of the first cleaner 41 is guided by the guiding groove 53. In other words, the insertion hole 44*a* of the first cleaner 41 has a space to convert the rotational motion of the pin 35 rotating in accordance with the rotation of the driven gear 33, into linear motion.

Figure 5:
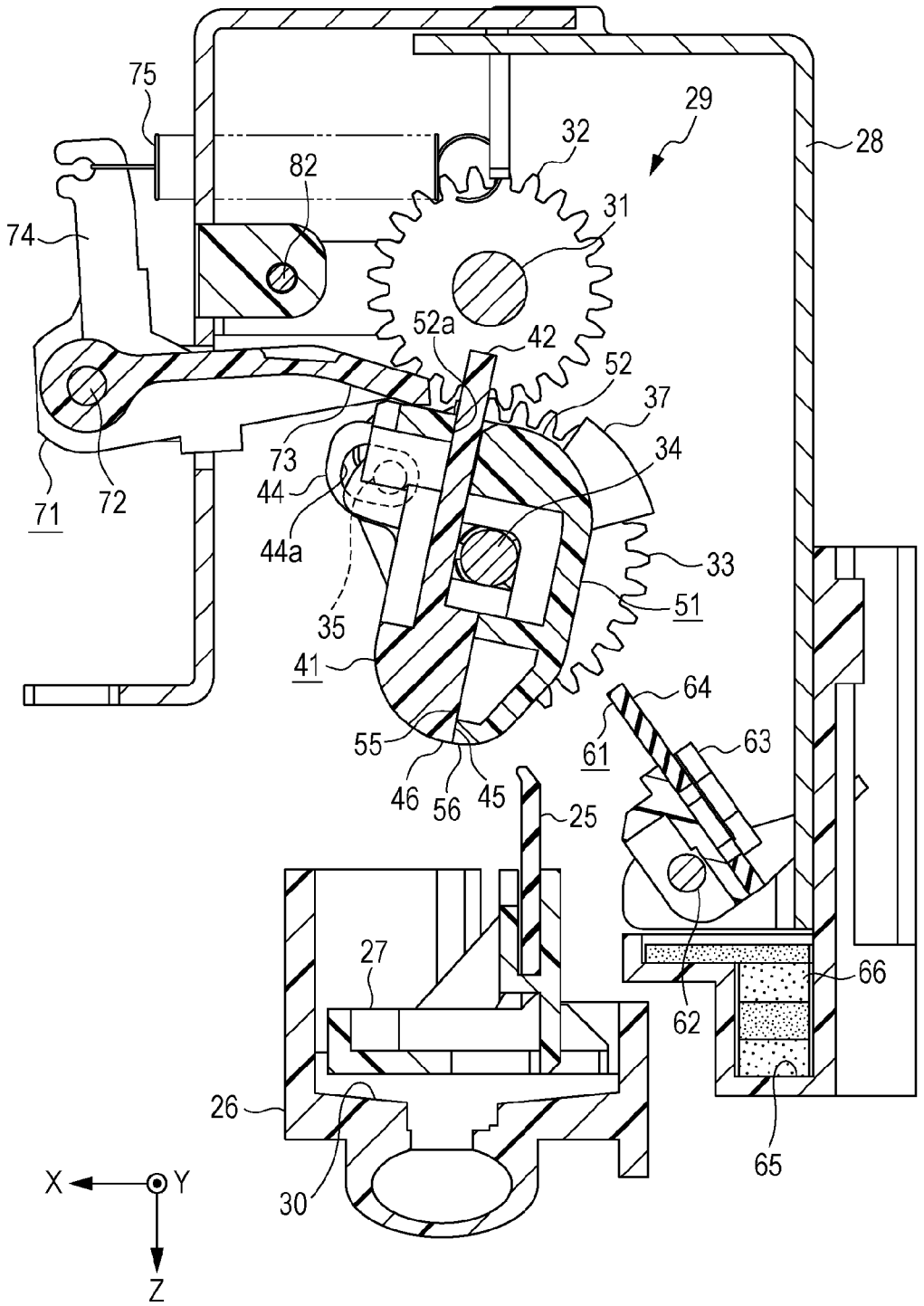
FIG. 5 is a cross-sectional view of the maintenance device taken along a surface shown by arrow line V-V in FIG. 3.

The third cleaner 61 is constituted by an elastically deformable member having a plate shape and the third cleaner 61 is held in a holding member 63 capable of pivoting on the third support shaft 62, as illustrated in FIG. 5. The third cleaner 61 has a recovery surface 64 extending from the tip end of the third cleaner 61 to the base end side. The tip end of the third cleaner 61 is located above the base end in the vertical direction.

The third cleaner 61 is disposed further to the home side (which is the right side in FIG. 5) in the movement direction X than both the wiper 25 and the rotation shaft 34. In the initial position illustrated in FIG. 5, the tip end side of the third cleaner 61 is inclined further to the opposite home side (which is the left side in FIG. 5) than the base end side, in a state where the recovery surface 64 is directed to the upper side in the vertical direction.

An accommodation portion 65 is provided in the vertically below the third cleaner 61, to accommodate the attached material, such a liquid, recovered by the third cleaner 61. It is preferable that an absorbing material 66 capable of absorbing liquid be provided in the accommodation portion 65.

It is preferable that the movement body 26 include a holding portion 27 for holding the wiper 25 and a liquid accommodation portion 30. The liquid accommodation portion 30 accommodates the liquid which flows along the wiper 25 and drips down. Furthermore, it is preferable that the tip end portion of the wiper 25 be bent to the opposite home side (which is the left side in FIG. 5). The reason for this is that, when wiping is performed, the bent tip end portion can effectively scrape off the attached material.

The first cleaner 41 has a scraping surface 45 and a tip end surface 46. The scraping surface 45 having a flat shape extends from the tip end of the first cleaner 41 to the base end side. The tip end surface 46 having a curved shape intersects the scraping surface 45, in the tip end of the first cleaner 41. In the first cleaner 41, both the scraping surface 45 and the tip end surface 46 are arranged further to the tip end side than the rotation shaft 34.

The second cleaner 51 has a guiding surface 55 and a holding surface 56. The guiding surface 55 having a flat shape extends from the tip end of the second cleaner 51 to the base end side. The holding surface 56 having a curved shape intersects the guiding surface 55, in the tip end of the second cleaner 51. In the second cleaner 51, both the guiding surface 55 and the holding surface 56 are arranged further to the tip end side than the rotation shaft 34.

Both the scraping surface 45 of the first cleaner 41 and the guiding surface 55 of the second cleaner 51 are flat surfaces extending in both the radial direction and axial direction (which is the direction perpendicular to the paper surface of FIG. 5) of the rotation shaft 34. Both the scraping surface 45 and the tip end surface 46 of the first cleaner 41 and both the guiding surface 55 and the holding surface 56 of the second cleaner 51 extend in the axial direction of the rotation shaft 34. The axial length thereof is longer than that of the wiper 25 and shorter than that of the third cleaner 61.

Next, the operation of the cleaning mechanism 29 for cleaning the wiper 25 in a state where the wiping operation is finished will be described.

When the wiping is finished, the wiper 25 moves to the initial position illustrated in FIG. 5. When the wiper 25 does not perform cleaning, each component of the cleaning mechanism 29 is located at the initial position illustrated in FIG. 5 and a standby state is maintained.

In the initial position illustrated in FIG. 5, the holding surface 56 provided in the tip end of the second cleaner 51 is located at a position closer to the third cleaner 61 than the tip end surface 46 of the first cleaner 41. The tip end positions of both the first cleaner 41 and the second cleaner 51 are aligned in the initial position illustrated in FIG. 5. In this case, the scraping surface 45 of the first cleaner 41 is in surface-contact with the guiding surface 55 of the second cleaner 51. In addition, both the tip end surface 46 of the first cleaner 41 and the holding surface 56 of the second cleaner 51 form one curved surface.

In the initial position illustrated in FIG. 5, the tip ends of both the first cleaner 41 and the second cleaner 51 are located on a side vertically above the tip end (the upper end) of the wiper 25 in the initial position. Accordingly, when the wiper 25 in a state where the wiping operation is finished moves, toward the home side, to reach the initial position illustrated in FIG. 5, the wiper 25 does not come into contact with either of the first cleaner 41 and the second cleaner 51. The initial position of the wiper 25 is a position set in a portion between the scraping surface 45 of the first cleaner 41 and the third cleaner 61, in relation to the movement direction X.

When the wiper 25 performs cleaning, first, the driving shaft 31 rotates in the clockwise direction in FIG. 5. Subsequently, rotation of the driving gear 32 which rotates in accordance with the driving shaft 31 is transmitted to the driven gear 33, and thus the rotation shaft 34 rotates in a first rotation direction (which is the counterclockwise direction in FIG. 5). Next, both the first cleaner 41 and the second cleaner 51 pivot in a first pivoting direction (which is the counterclockwise direction in FIG. 5), in accordance with rotation of the rotation shaft 34.

In the initial position illustrated in FIG. 5, the protrusion portion 42 of the first cleaner 41 is separated from the first arm portion 73 of the first lever 71. However, when the first cleaner 41 pivots in the first pivoting direction, the protrusion portion 42 of the first cleaner 41 engages with the first arm portion 73.

Figure 6:
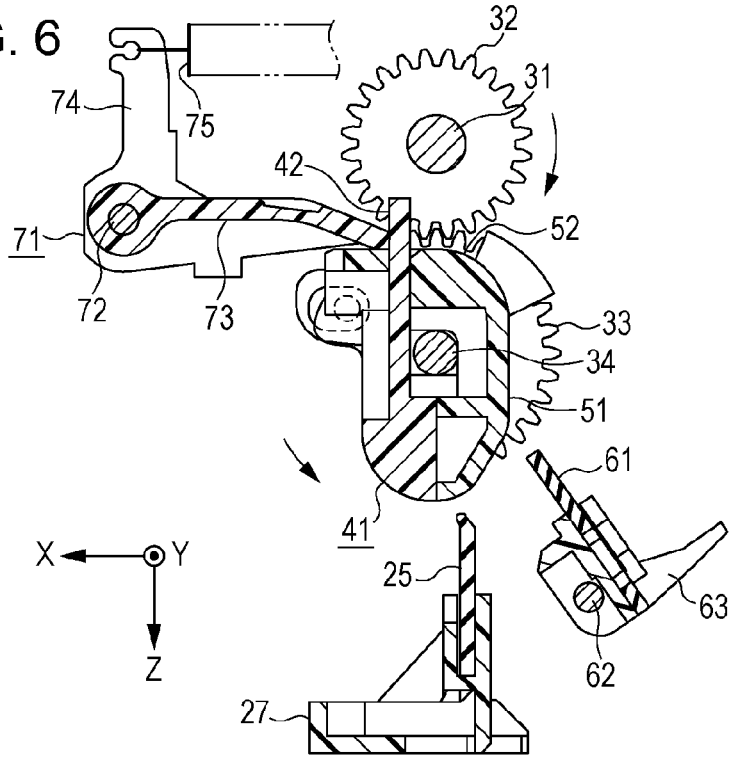
FIG. 6 is a cross-sectional view illustrating first positions of both a first cleaner and a second cleaner.

When the protrusion portion 42 of the first cleaner 41 is engaged with the first arm portion 73 of the first lever 71, as illustrated in FIG. 6, pivoting of both the first cleaner 41 and the second cleaner 51 is regulated in the first pivoting direction (which is the counterclockwise direction in FIG. 6). The position (which is the position illustrated in FIG. 6) of both the first cleaner 41 and the second cleaner 51 in a state where the pivoting thereof in the first pivoting direction is regulated by the first lever 71 is referred to as a first position. In the first position, both the scraping surface 45 of the first cleaner 41 and the guiding surface 55 of the second cleaner 51 extend in the vertical direction.

Figure 7:
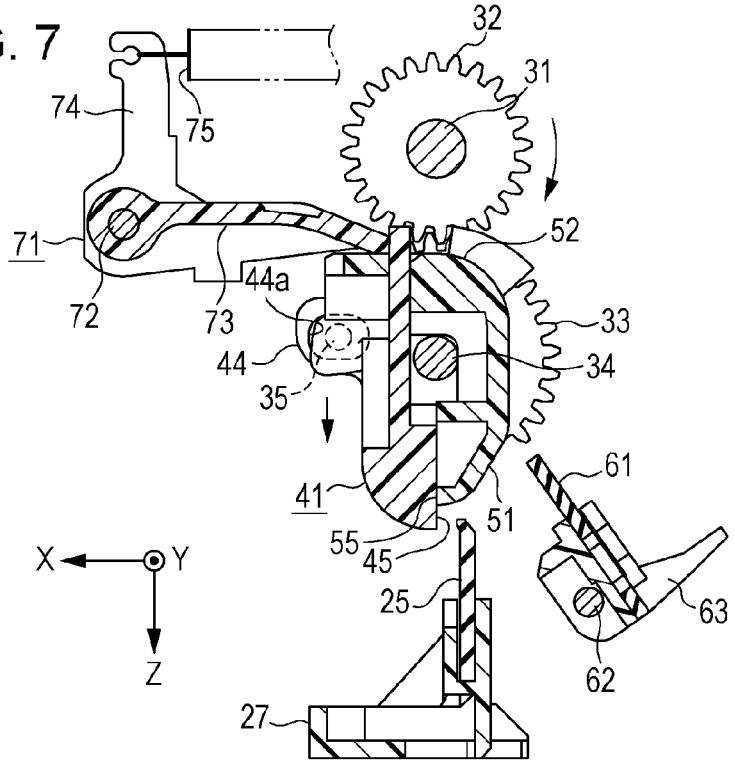
FIG. 7 is a cross-sectional view illustrating the first cleaner in a slide-moving state.

When the rotation shaft 34 rotates in a first rotating direction, in a state where pivoting of both the first cleaner 41 and the second cleaner 51 is regulated, as illustrated in FIG. 7, the first cleaner 41 is pressed by the pin 35 rotating in accordance with the rotation shaft 34. As a result, the first cleaner 41 moves, in a sliding manner, to the vertically lower side. In this case, the scraping surface 45 extending from the tip end of the first cleaner 41 to the base end side moves along the guiding surface 55 of the second cleaner 51, in a direction (which is a direction directed to the vertically lower side) in which the scraping surface 45 moves away from the rotation shaft 34.

Figure 8:
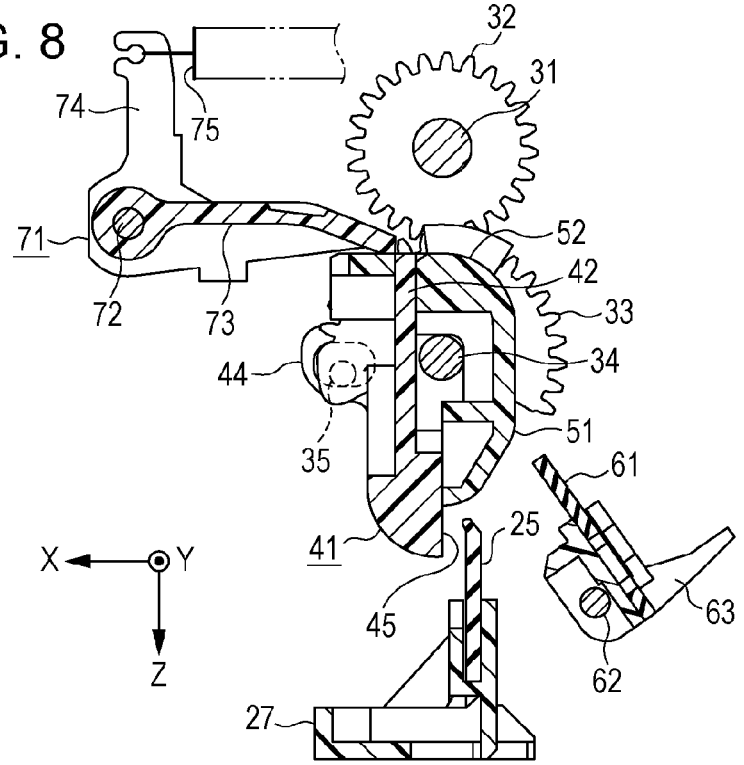
FIG. 8 is a cross-sectional view illustrating second positions of both the first cleaner and the second cleaner.

When the first cleaner 41 moves vertically downward and the protrusion portion 42 of the first cleaner 41 is accommodated in the engagement portion 52 of the second cleaner 51, as illustrated in FIG. 8, the engagement between the first arm portion 73 of the first lever 71 and the protrusion portion 42 is released. The position (which is the position illustrated in FIG. 8) of both the first cleaner 41 and the second cleaner 51 in a state where the engagement between the protrusion portion 42 and the first lever 71 is referred to as a second position. In the second position, the scraping surface 45 of the first cleaner 41 is located further to the opposite home side (which is the left side in FIG. 8) than the tip end portion of the wiper 25. Furthermore, the scraping surface 45 and the tip end portion of the wiper 25 overlap in the vertical direction (that is, the gravity direction Z).

Figure 9:
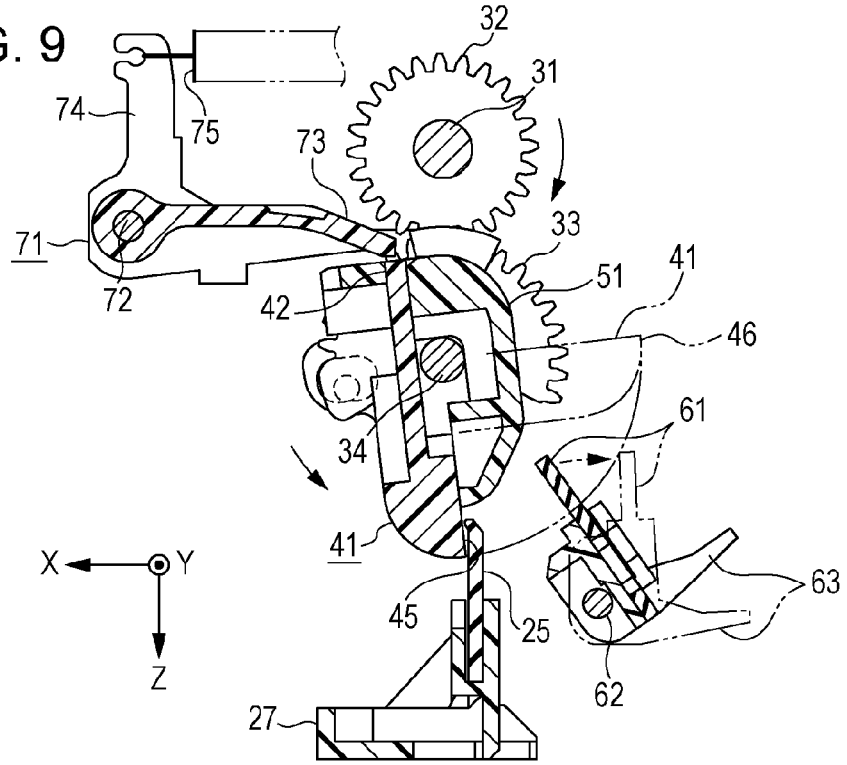
FIG. 9 is a cross-sectional view illustrating a state where the first cleaner cleans a wiper.

When the engagement between the first arm portion 73 and the protrusion portion 42 is released, as illustrated in FIG. 9, pivoting of both the first cleaner 41 and the second cleaner 51 in the first pivoting direction restarts in accordance with the rotation of the rotation shaft 34 in the first rotating direction. In this case, the first cleaner 41 cleans the wiper 25, in such a manner that the first cleaner 41 in a state where the tip end thereof is located on a side vertically below the base end pivots in a direction in which the tip end moves to the vertically upper side. In other words, the wiper 25 and the first cleaner 41 relatively move in a state where the tip end sides of both the wiper 25 and the first cleaner 41 come into contact with each other and the base end sides thereof are separated, and thus the attached material on the tip end portion (particularly, the left side surface in FIG. 9) of the wiper 25 is scraped off by the scraping surface 45 of the first cleaner 41.

Then, the first cleaner 41 pivots, in accordance with the rotation of the rotation shaft 34 in the first rotating direction, to the position (which is a third position illustrated in FIG. 11) illustrated by a two-dot chain line in FIG. 9. Initial positions of the tip end portions of both the wiper 25 and the third cleaner 61 are the positions in which the tip end portions are located on the pivoting path (illustrated by a one-dot chain line in FIG. 9) of the scraping surface 45 of the first cleaner 41 pivoting from the second position.

Figure 10:
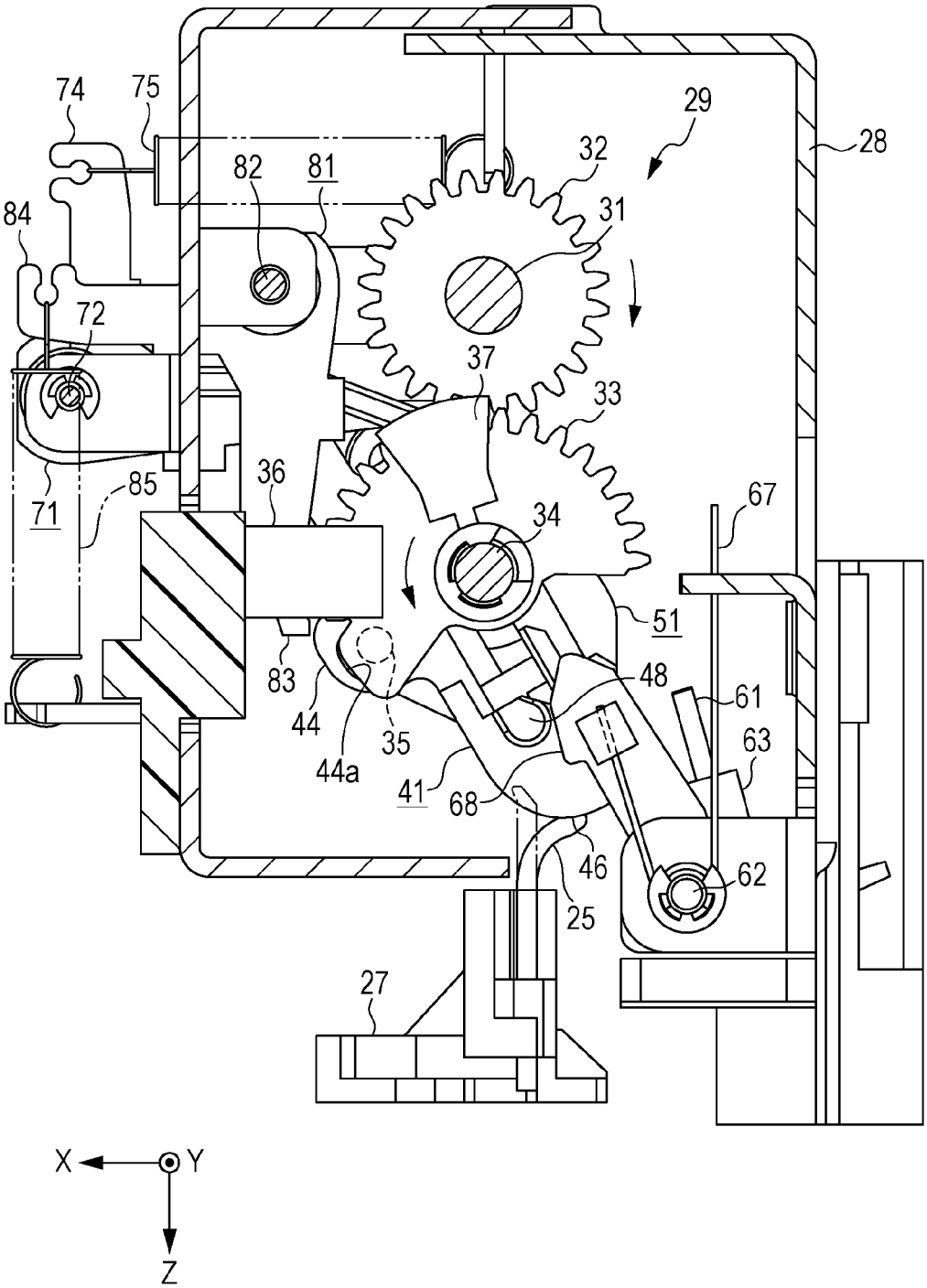
FIG. 10 is a cross-sectional view of the maintenance device taken along a surface shown by arrow line X-X in FIG. 3.

Accordingly, when the first cleaner 41 pivots, the scraping surface 45 is strongly pressed against the wiper 25, and thus the wiper 25 is elastically deformed, as illustrated in FIG. 10. Then, when the first cleaner 41 passes over the wiper 25, the wiper 25 returns to the initial shape illustrated by a two-dot chain line in FIG. 10. It is preferable that the length of the wiper 25 in the relative movement direction between the wiper 25 and the first cleaner 41 be shorter than that of the first cleaner 41. In this case, the wiper 25 can be easily elastically deformed.

The first cleaner 41 in a state where the first cleaner 41 pivots in the first pivoting direction comes into contact with the wiper 25, and then the first cleaner 41 moves close to the third cleaner 61. However, it is not preferable that the scraping surface 45 of the first cleaner 41 in a state where the scraping surface 45 cleans the wiper 25 come into contact with the third cleaner 61. The reason for this is that the attached material scraped off by the scraping surface 45 adheres to the third cleaner 61.

Accordingly, the following configuration is preferable. A cam portion 68 is provided in the holding member 63 of the third cleaner 61 and a convex portion 48 is provided in the first cleaner 41, as illustrated in FIG. 10. The convex portion 48 of the first cleaner 41 pivoting in the first pivoting direction presses the cam portion 68 of the holding member 63, and thus the third cleaner 61 pivots. In this case, the third cleaner 61 pivots, in accordance with pivoting of the first cleaner 41, from the initial position to the position illustrated by the two-dot chain line in FIG. 9, and thus it is possible to prevent unnecessary contact between the scraping surface 45 of the first cleaner 41 and the third cleaner 61.

It is preferable that the third cleaner 61 be biased to the initial position in such a manner that, for example, the holding member 63 is engaged with a biasing member 67 constituted by, for example, a torsion coil spring. In this case, when the convex portion 48 separates from the cam portion 68, in accordance with pivoting of the first cleaner 41, the biasing force of the biasing member 67 can return the third cleaner 61 to the initial position.

Figure 11:
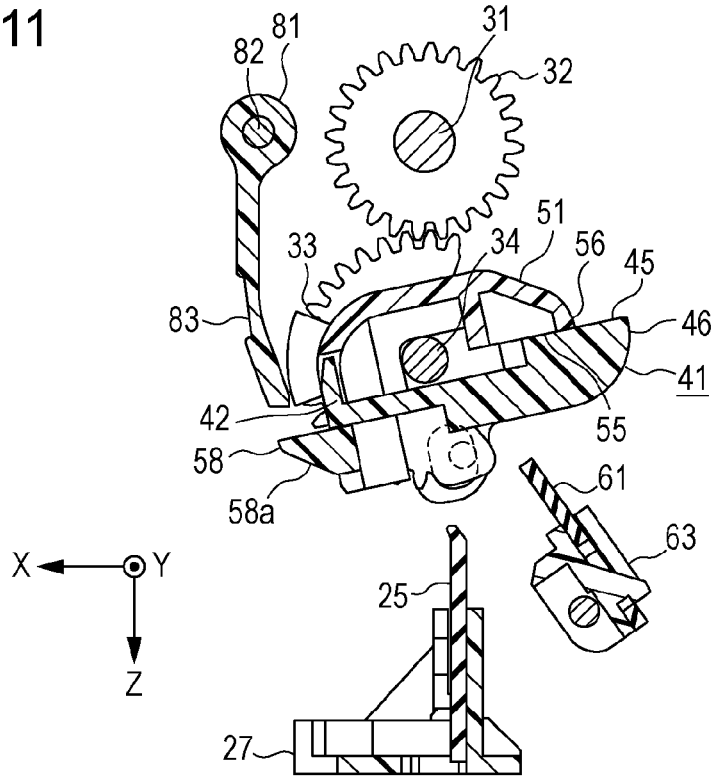
FIG. 11 is a cross-sectional view illustrating third positions of both the first cleaner and the second cleaner.

When the first cleaner 41 pivoting in the first pivoting direction separates from the wiper 25, as illustrated in FIG. 11, the rotating direction of the driving shaft 31 is reversed. In other words, the driving shaft 31 rotates in the counterclockwise direction in FIG. 11, and thus the rotation shaft 34 rotates in a second rotating direction (which is the clockwise direction in FIG. 11). Then, both the first cleaner 41 and the second cleaner 51 pivot in the second rotating direction (which is the clockwise direction in FIG. 11), in accordance with rotation of the rotation shaft 34 in the second rotating direction.

When the detecting unit 36 (see FIGS. 3 and 10) detects that the amount of rotation of the rotation shaft 34 has reached the predetermined threshold value, the rotating direction of the driving shaft 31 may be reversed. In this embodiment, a position (which is the position illustrated in FIG. 11) of both the first cleaner 41 and the second cleaner 51 in a state where the driving shaft 31 starts to rotate in the reverse direction is referred to as a third position. In the third position, the protrusion portion 58 of the second cleaner 51 is separated from the first arm portion 83 of the second lever 81.

Figure 12:
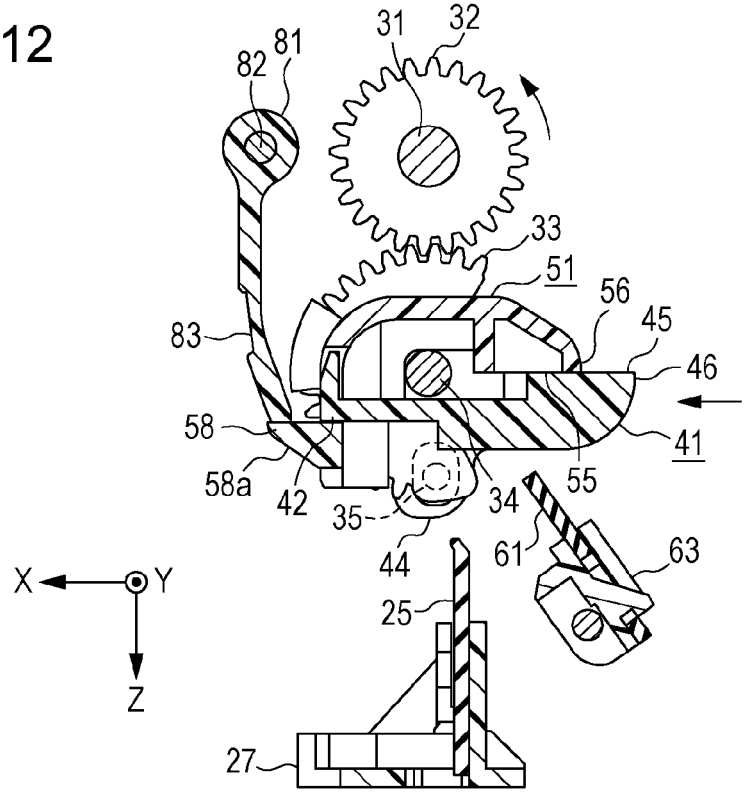
FIG. 12 is a cross-sectional view illustrating fourth positions of both the first cleaner and the second cleaner.

When the protrusion portion 58 of the second cleaner 51 pivoting in a second pivoting direction, in accordance with the reverse rotation of the driving shaft 31, engages with the first arm portion 83 of the second lever 81, as illustrated in FIG. 12, pivoting of both the first cleaner 41 and the second cleaner 51 is regulated. A position (which is the position illustrated in FIG. 12) of both the first cleaner 41 and the second cleaner 51 in a state where the second lever 81 regulates pivoting of both the cleaners in the second pivoting direction is referred to as a fourth position.

When the rotation shaft 34 rotates in the second rotating direction, in a state where pivoting of both the first cleaner 41 and the second cleaner 51 is regulated, the pin 35 rotating along with the rotation shaft 34 presses the first cleaner 41. As a result, the scraping surface 45 moves, in a sliding manner, in a direction in which the scraping surface 45 moves close to the rotation shaft 34.

In this case, both the first cleaner 41 and the second cleaner 51 relatively move in a direction in which the tip ends thereof are aligned, in a state where the holding surface 56 is disposed on the vertically upper side of the scraping surface 45, as illustrated in FIG. 12. In other words, the first cleaner 41 moves, in a sliding manner, to the left side in FIG. 12. Then, the first cleaner 41 and the second cleaner 51 relatively move in a state where the holding surface 56 is in contact with the scraping surface 45, and thus the attached material on the scraping surface 45 is scraped off by the holding surface 56. Subsequently, the holding surface 56 moves to the tip end sides of both the first cleaner 41 and the second cleaner 51.

Figure 13:
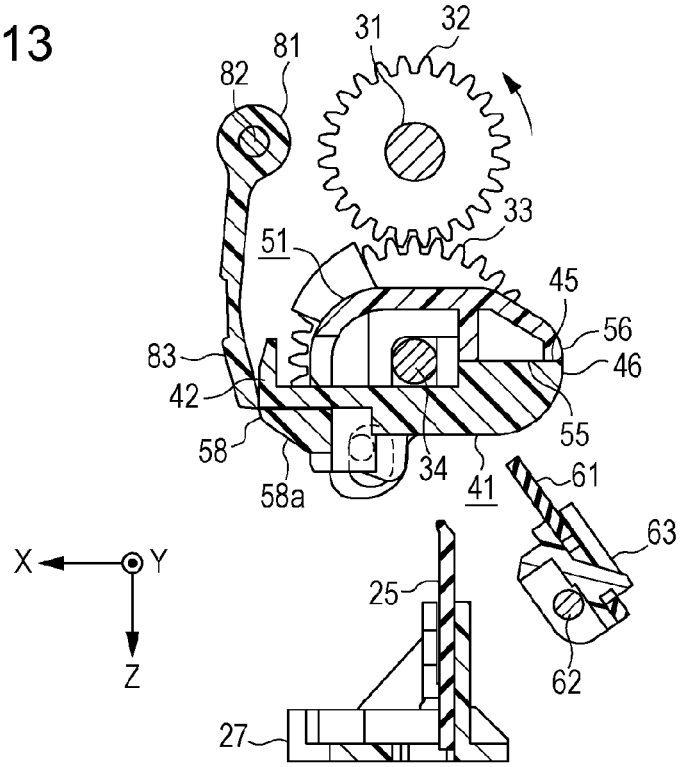
FIG. 13 is a cross-sectional view illustrating fifth positions of both the first cleaner and the second cleaner.

When the guiding surface 55 and the scraping surface 45 are in surface-contact with each other and both the tip end surface 46 and the holding surface 56 form one curved surface, as illustrated in FIG. 13, the relative movement between the first cleaner 41 and the second cleaner 51 is finished. In this case, the attached material which is scraped off from the scraping surface 45 by the second cleaner 51 collects in the tip ends of both the first cleaner 41 and the second cleaner 51.

When the first cleaner 41 moves, in a sliding manner, with respect to the second cleaner 51, as described above, the protrusion portion 42 of the first cleaner 41 protrudes from the engagement portion 52 of the second cleaner 51. Subsequently, the protrusion portion 42 presses the first arm portion 83 and the second lever 81 pivots in the clockwise direction in FIG. 13. When the sliding movement of the first cleaner 41 is finished, the engagement between the first arm portion 83 of the second lever 81 pivoting in accordance with pressing of the protrusion portion 42 and the protrusion portion 58 of the second cleaner 51 is released. A position (which is the position illustrated in FIG. 13) of both the first cleaner 41 and the second cleaner 51 in a state where the engagement between the first arm portion 83 and the protrusion portion 58 is released is referred to as a fifth position.

When the engagement between the first arm portion 83 and the protrusion portion 58 is released, pivoting of both the first cleaner 41 and the second cleaner 51 in the second pivoting direction (which is the clockwise direction in FIG. 13) restarts in accordance with rotation of the rotation shaft 34 in the second rotating direction (which is the clockwise direction in FIG. 13).

Figure 14:
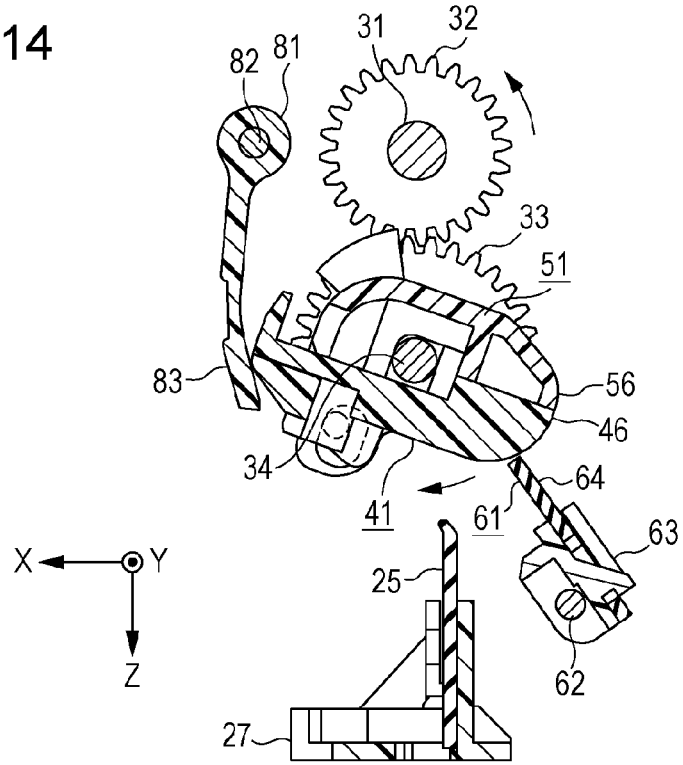
FIG. 14 is a cross-sectional view illustrating both the first cleaner and the second cleaner in a state where both cleaners pivot from the fifth positions toward the initial positions.

In this case, the tip ends of both the first cleaner 41 and the second cleaner 51 pivot in a direction in which the tip ends moves to the vertically lower side, and thus both the holding surface 56 and the tip end surface 46 come into contact with the recovery surface 64 of the third cleaner 61, which extends from the tip end to the base end side, as illustrated in FIG. 14. Accordingly, the attached material collected in the holding surface 56 of the second cleaner 51 is scraped off by the recovery surface 64 of the third cleaner 61. In other words, the third cleaner 61 recovers the attached material on the holding surface 56, in such a manner that the third cleaner 61 comes into contact with the holding surface 56 of the second cleaner 51. Subsequently, when both the first cleaner 41 and the second cleaner 51 pivot to the initial positions illustrated in FIG. 5, the operation of the cleaning mechanism 29 is finished.

When both the first cleaner 41 and the second cleaner 51 pivot in the first pivoting direction, the first arm portion 83 is pressed by the inclined surface 58*a* of the protrusion portion 58. Accordingly, even in a state where the first arm portion 83 comes into contact with the protrusion portion 58, pivoting of both the first cleaner 41 and the second cleaner 51 is not regulated due to pivoting of the first arm portion 83 in the clockwise direction in FIG. 12.

Next, the maintenance method of the maintenance device 14, performed on the liquid ejecting portion 18, will be described in addition to the maintenance device 14 of this embodiment, the liquid ejecting apparatus 11, and the operation of the maintenance method.

In the maintenance device 14, a wiping process is performed in such a manner that wiper 25 wipes the opening surface 20 of the liquid ejecting portion 18 as a target object, as illustrated by the two-dot chain line in FIG. 1. In this case, the elastically deformed tip end portion of the wiper 25 comes into slide-contact with the opening surface 20. Accordingly, the contact area of the wiper 25, relative to the opening surface 20, is reduced, and thus the elastic restoring force of the wiper 25 is concentrated on the tip end portion. As a result, material, such as dried ink, fixed to the opening surface 20 can be strongly scraped. When the wiping process is finished, the wiper 25 in a state where wiping of the wiper 25 on the liquid ejecting portion 18 is finished moves to the initial position illustrated by solid line in FIG. 1.

Then, a movement process is performed in such a manner that the first cleaner 41 moves, in a sliding manner, from the first position illustrated in FIG. 6 to the second position illustrated in FIG. 8, in accordance with rotation of the rotation shaft 34 in the first rotating direction. The movement in this case is referred to as a first outward movement.

Subsequently, in a first cleaning process, the first cleaner 41 pivots in the first pivoting direction, from the second position illustrated in FIG. 8 to the third position illustrated in FIG. 11 and the first cleaner 41 cleans the wiper 25 in a state where the attached material adheres thereto during the wiping operation. Pivoting of both the first cleaner 41 and the second cleaner 51 in this case is referred to as a second outward movement.

In this case, an edge portion of the first cleaner 41, in which the scraping surface 45 intersects the tip end surface 46, is in slide-contact with the opposite-home-side surface (in other words, the surface to which the attached material adheres in the wiping operation) of the wiper 25. Accordingly, the contact area of the first cleaner 41, relative to the wiper 25, is reduced, and thus the attached material on the wiper 25 can be scraped off in a state where the contact pressure of the first cleaner 41 is concentrated on the wiper 25.

Since the wiper 25 stands vertically, liquid components adhering to the wiper 25 during the wiping operation flow downward to move toward the lower end side. As a result, solid material, such as solute components of solidified ink and paper dust, is likely to remain in the tip end side of the wiper 25. This material remaining is not preferable. The reason for this is that, when such solid material remains on the wiper 25 during a subsequent wiping operation, there is a concern that the solid material may adhere to the opening surface 20.

The first cleaner 41 is configured so that the tip end of the first cleaner 41 pivots to move to the vertically upper side and the first cleaner 41 wipes the tip end portion of the wiper 25 from the lower side to the upper side. Accordingly, the first cleaner 41 can scoop up and remove the solid material adhering to the wiper 25. In contrast, when the first cleaner 41 wipes the wiper 25 from the upper side to the lower side thereof, the solid material is pressed downward to move from the tip end side of the wiper 25 to the lower end side. Accordingly, there is a concern that the solid material may remain on the wiper 25.

The tip end surface 46 of the first cleaner 41 is curved, as illustrated in FIG. 10. Thus, when the first cleaner 41 separates from the wiper 25, the wiper 25 can return to the initial posture, in a state where the tip end of the wiper 25 slides along the curved tip end surface 46. As a result, there is no possibility that, when the wiper 25 separated from the first cleaner 41 quickly returns to the initial posture, liquid remaining in the wiper 25 may be scattered around.

Subsequently, in the second cleaning process, the first cleaner 41 moves, in a sliding manner, from the fourth position illustrated in FIG. 12 to the fifth position illustrated in FIG. 13. Thus, the holding surface 56 of the second cleaner 51 cleans the scraping surface 45 of the first cleaner 41, to which the attached material adheres during cleaning in the first cleaning process. The movement in this case is referred to as a first returning movement corresponding to the first outward movement in the movement process.

In this case, an edge portion of the second cleaner 51, in which the guiding surface 55 intersects the holding surface 56, is in slide-contact with the scraping surface 45. Accordingly, the attached material on the scraping surface 45 can be thoroughly removed. In this case, since the scraping surface 45 to which the attached material containing a solid material adheres is directed to the vertically upper side, dripping or scattering of the attached material scraped off by the second cleaner 51 is prevented. Furthermore, in the scraping surface 45, a portion subjected to removing of the attached material is covered by the guiding surface 55. Accordingly, even when, for example, liquid is scattered over the scraping surface 45, during scraping, the scattered liquid, for example, is prevented from adhering to a part of the scraping surface 45, which is the portion subjected to removing of the attached material.

When, in the third cleaning process, both the first cleaner 41 and the second cleaner 51 pivot in the second pivoting direction to move from the fifth position illustrated in FIG. 13 to the initial position, the recovery surface 64 of the third cleaner 61 can recover the attached material on the holding surface 56 of the second cleaner 51, during cleaning in the second cleaning process. Pivoting of both the first cleaner 41 and the second cleaner 51 in this case is referred to as a second returning movement corresponding to the second outward movement in the first cleaning process.

In this case, the tip end portion of the third cleaner 61, in which the recovery surface 64 is provided, is in slide-contact with the holding surface 56, as illustrated in FIG. 14. Accordingly, the contact area of the third cleaner 61, relative to the holding surface 56, is reduced, and thus the contact pressure of the third cleaner 61 is concentrated on the holding surface 56. As a result, the attached material on the holding surface 56 can be effectively scraped off.

It is preferable that the length of the third cleaner 61 in the relative movement direction between the second cleaner 51 and the third cleaner 61 be shorter than that of the second cleaner 51. In this case, when the third cleaner 61 comes into contact with the second cleaner 51, the third cleaner 61 is elastically deformed, and thus the contact pressure between the third cleaner 61 and the holding surface 56 can be increased.

In some cases, the attached material collected in the holding surface 56 of the second cleaner 51, during the second cleaning process, flows downward, by the action of gravity, to flow to the tip end surface 46 of the first cleaner 41, which is located on the lower side. However, in the third cleaning process, the third cleaner 61 comes into contact with the tip end surface 46 of the first cleaner 41, and then comes into slide-contact with the holding surface 56 of the second cleaner 51. Accordingly, the third cleaner 61 can recover the attached material flowing to the tip end surface 46, along with the attached material collected in the holding surface 56.

Since the recovery surface 64 of the third cleaner 61 is inclined in a state where the recovery surface 64 is directed to the vertically upper side, dripping of the attached material scraped from the holding surface 56 is prevented. In addition, since the accommodation portion 65 is disposed on the side vertically below the recovery surface 64, the attached material on the recovery surface 64 flows along the recovery surface 64 and is recovered by the accommodation portion 65.

Furthermore, the holding surface 56 is curved. Thus, when the third cleaner 61 separates from the holding surface 56, the third cleaner 61 can return to the initial posture, in a state where the tip end of the third cleaner 61 slides along the curved holding surface 56. As a result, there is no possibility that, when the third cleaner 61 separated from the holding surface 56 quickly returns to the initial posture, the attached material on the third cleaner 61 may be scattered around. The direction in which the third cleaner 61 returns to the initial posture is the direction opposite to the pivoting direction of both the first cleaner 41 and the second cleaner 51. Thus, even when the attached material is scattered due to the momentum of the third cleaner 61 returning to the initial posture, the attached material is prevented from adhering to the first cleaner 41 or the second cleaner 51.

Both the first cleaner 41 and the second cleaner 51 are subjected to the first outward movement in the movement process, the second outward movement in the first cleaning process, the first returning movement in the second cleaning process, and the second returning movement in the third cleaning process, and then return to the initial position. Accordingly, after the series of cleaning operations is performed, both the first cleaner 41 and the second cleaner 51 can be prepared for the subsequent cleaning operation without moving, for example, specific components.

The first cleaner 41 cleans off the attached material on the wiper 25, the second cleaner 51 removes the attached material on the first cleaner 41, and the third cleaner 61 recovers the attached material removed by the second cleaner 51. Furthermore, in a pivot-axial direction of both the first cleaner 41 and the second cleaner 51, the length of the scraping surface 45 of the first cleaner 41 or the holding surface 56 of the second cleaner 51 is longer than that of the tip end of the wiper 25 and shorter than that of the recovery surface 64 of the third cleaner 61. Thus, the wiper 25, the scraping surface 45 of the first cleaner 41, and the holding surface 56 of the second cleaner 51 are held in a state where attached material does not remain thereon. Then, the wiper 25 on which attached material does not remain, as described above, wipes the liquid ejecting portion 18, and thus the ejection port 21 is maintained in a clean state. As a result, failure in liquid ejection can be prevented or eliminated.

According to the embodiment described above, the following effects can be obtained.

(1) The first cleaner 41 cleans off the attached material on the wiper 25, and then the second cleaner 51 cleans the first cleaner 41 to which the attached material adheres during cleaning. Thus, a decrease in the function of cleaning the first cleaner 41 for cleaning the wiper 25 can be prevented by the wiper 25. Furthermore, a clean state of the wiper 25 is maintained by cleaning, and thus a decrease in the wiping performance of the liquid ejecting portion 18 can be prevented. In other words, since the target object is wiped using the wiper 25 which is cleaned by the first cleaner 41 and does not have attached material remaining thereon, adhering of remaining attached material to the target object is prevented. As a result, the target object can be always maintained in a clean state.

(2) The wiper 25 and the first cleaner 41 relatively move in a state where the tip end side of the wiper 25 is in contact with the tip end side of the first cleaner 41. As a result, the first cleaner 41 can effectively scrape the attached material on the wiper 25.

(3) The first cleaner 41 pivots in a direction in which the tip end moves to the vertically upper side. Thus, the wiper 25 can be cleaned from the vertically lower side to the upper side. As a result, the attached material can be moved from the wiper 25 to the first cleaner 41, in a state where dripping of the attached material on the wiper 25 is prevented.

(4) When the first cleaner 41 moves relative to the second cleaner 51, the holding surface 56 provided in the tip end of the second cleaner 51 comes into contact with scraping surface 45. As a result, the edge portion of the holding surface 56 can effectively scrape the attached material on the scraping surface 45.

(5) When the first cleaner 41 moves relative to the second cleaner 51, the holding surface 56 is disposed on the vertically upper side of the scraping surface 45. Thus, when the holding surface 56 scrapes off the attached material on the scraping surface 45, dripping of the attached material is prevented. Furthermore, when the tip ends of both the first cleaner 41 and the second cleaner 51 are aligned through the relative movement, the attached material can be removed from the scraping surface 45 of the first cleaner 41.

(6) When the relative movement between the first cleaner 41 and the second cleaner 51 is finished, the attached material moved from the scraping surface 45 adheres to the holding surface 56 of the second cleaner 51. In this case, both the holding surface 56 and the tip end surface 46 form one surface. Thus, when the third cleaner 61 comes into contact with the holding surface 56 and recovers the attached material, a hindrance to the recovery movement of the third cleaner 61, resulting from the contact between the third cleaner 61 and, for example, the scraping surface 45 of the first cleaner 41, is prevented.

(7) When the relative movement between the first cleaner 41 and the second cleaner 51 is finished, both the tip end surface 46 and the holding surface 56 form a curved surface. As a result, the tip end portion of the third cleaner 61 can effectively scrape the attached material on the holding surface 56 of the second cleaner 51 in a pivoting state.

(8) The accommodation portion 65 is disposed below the recovery surface 64 of the third cleaner 61 in the vertical direction. As a result, the attached material dripping from the recovery surface 64 of the third cleaner 61 can be accommodated in the accommodation portion 65.

(9) In the pivot-axial direction of the second cleaner 51, the length of the scraping surface 45 of the first cleaner 41 or the holding surface 56 of the second cleaner 51 is longer than that of the tip end of the wiper 25. Thus, the first cleaner 41 can scrape the attached material on the wiper 25, without attached material remaining. In addition, the second cleaner 51 can scrape the attached material on the first cleaner 41, without attached material remaining. Furthermore, in the pivot axial direction of the second cleaner 51, the length of the recovery surface 64 of the third cleaner 61 is longer than that of the holding surface 56 of the second cleaner 51. Thus, the third cleaner 61 can scrape the attached material on the second cleaner 51, without attached material remaining. In other words, since the target object is wiped using the wiper 25 which is cleaned by the first cleaner 41 and does not have attached material remaining thereon, adhering of attached material remaining to the target object is prevented. As a result, the target object can be always maintained in a clean state.

(10) The length of the wiper 25 in the relative movement direction between the wiper 25 and the first cleaner 41 is shorter than that of the first cleaner 41. Accordingly, when the wiper 25 comes into contact with the first cleaner 41, the wiper 25 is elastically deformed, and thus the wiper 25 is pressed to the first cleaner 41. As a result, the first cleaner 41 can effectively scrape the attached material on the wiper 25.

(11) The length of the third cleaner 61 in the relative movement direction between the second cleaner 51 and the third cleaner 61 is shorter than that of the second cleaner 51. Accordingly, when the third cleaner 61 comes into contact with the second cleaner 51, the third cleaner 61 is elastically deformed, and thus the third cleaner 61 is pressed to the second cleaner 51. As a result, the third cleaner 61 can effectively scrape the attached material on the second cleaner 51.

The embodiment described above may be modified as in the following modification examples.

In the fifth position illustrated in FIG. 13, both the tip end surface 46 of the first cleaner 41 and the holding surface 56 of the second cleaner 51 may form one flat surface. In this case, the attached material on the holding surface 56 can be recovered by the third cleaner 61, in such a manner that the third cleaner 61 having an elastically-undeformable recovery surface moves, in a sliding manner, in the vertical direction in a state where the recovery surface of the third cleaner 61 comes into contact with both the tip end surface 46 and the holding surface 56. In a case where the configuration described above is applied, it is preferable that a material capable of adsorbing liquid or an accommodation portion capable of accommodating attached material be disposed ahead of the moved third cleaner 61.

The maintenance device 14 may not include the third cleaner 61. In this case, dripping of attached material, such as liquid, on the second cleaner 51 can be prevented in such a manner that a material capable of absorbing liquid is disposed in the tip end portion of the second cleaner 51.

Alternatively, in a case where the third cleaner 61 is not provided, the first cleaner 41 may rotate integrally with the rotation shaft 34 and the second cleaner 51 capable of elastic deformation may be located on the pivoting path of the first cleaner 41. In this case, the attached material on the scraping surface 45 can be moved to the second cleaner 51, in such a manner that, when the first cleaner 41 in a state where the first cleaner 41 cleans the wiper 25 pivots, the second cleaner 51 comes into contact with the second cleaner 51. In a case where the configuration described above is applied, the first cleaner 41 may rotate in the first rotating direction and return to the initial position while preventing the pivoting direction of the first cleaner 41 from being reversed.

The wiper 25 is not limited to a wiper for wiping the opening surface 20 of the liquid ejecting portion 18. In a case where a plate-shaped member capable of accommodating liquid discharged from the liquid ejecting portion 18 is provided and clogging of the nozzles 19 is prevented or eliminated by cleaning or flushing in which the liquid is discharged onto the plate-shaped member, the wiper 25 may wipe the plate-shaped member having liquid accommodated therein.

The liquid ejecting apparatus 11 may be changed to a so-called full-line type liquid ejecting apparatus which is not provided with the carriage 17 and is provided with a fixed liquid ejecting portion having a long length corresponding to the entire width (in other words, the length in the movement direction X) of the medium P. The printing range of the liquid ejecting portion in this case may extend over the entire width of the medium P, in such a manner that a plurality of unit head portions having nozzles formed therein are arranged in parallel. Alternatively, the printing range thereof may extend over the entire width of the medium P, in such a manner that a plurality of nozzles are arranged, in one long head, to extend over the entire width of the medium P.

A solution ejected by the liquid ejecting portion 18 is not limited to ink and may be a liquid into which particles of a functional material, for example, are dispersed or mixed. The liquid ejecting portion 18 may eject a liquid containing a material, such as an electrode material used for manufacturing a liquid crystal display, an electroluminescence (EL) display, and a surface-emitting display and a coloring material (a pixel material), in a dispersed or dissolved state.

What is claimed is:

1. A maintenance device comprising:

a wiper which wipes attached material on a target object;

a first cleaner which cleans the wiper to which the attached material adheres during wiping; and a second cleaner which cleans the first cleaner to which the attached material adheres during cleaning, wherein the first cleaner has a scraping surface for scraping off the attached material on the wiper, wherein the first cleaner and the second cleaner relatively move in a state where the second cleaner is in contact with the scraping surface.

2. The maintenance device according to claim 1, wherein the wiper and the first cleaner relatively move in a state where tip end sides thereof are in contact with each other and base end sides are separated and the first cleaner scrapes off the attached material on the wiper.

3. The maintenance device according to claim 1, wherein the first cleaner pivots in a direction in which the tip end thereof moves vertically upward, in a state where the tip end is located below the base end in a vertical direction, and the first cleaner cleans the wiper.

4. The maintenance device according to claim 1, wherein the second cleaner has a holding surface on a tip end thereof, and wherein the first cleaner and the second cleaner relatively move in a state where the holding surface is in contact with the scraping surface and the holding surface scrapes off the attached material on the scraping surface.

5. The maintenance device according to claim 4, wherein the scraping surface extends from the tip end of the first cleaner to a base end side, and wherein the first cleaner and the second cleaner relatively move in a direction in which the tip ends thereof are aligned, in a state where the holding surface is disposed on the vertically upper side of the scraping surface.

6. The maintenance device according to claim 5, further comprising:

a third cleaner which comes into contact with the holding surface of the second cleaner and recovers the attached material on the holding surface, wherein a tip end surface intersecting the scraping surface is provided in the tip end of the first cleaner, such that, when the relative movement between the first cleaner and the second cleaner is finished, the tip end surface and the holding surface form one surface.

7. The maintenance device according to claim 6, wherein the third cleaner has a recovery surface extending from a tip end of the third cleaner to a base end side, wherein the recovery surface of the third cleaner comes into contact with the holding surface of the second cleaner in a pivoting state and the third cleaner recovers the attached material on the holding surface, and wherein, when the relative movement between the first cleaner and the second cleaner is finished, the tip end surface and the holding surface form a curved surface.

8. The maintenance device according to claim 7, further comprising:

an accommodation portion which can accommodate the attached material recovered by the third cleaner, wherein the accommodation portion is disposed below the recovery surface in the vertical direction.

9. The maintenance device according to claim 7, wherein, in a pivot-axial direction of the second cleaner, the length of the scraping surface of the first cleaner or the holding surface of the second cleaner is longer than that of the tip end of the wiper and shorter than that of the recovery surface of the third cleaner.

10. A liquid ejecting apparatus comprising:

a liquid ejecting portion which can eject liquid;

a wiper which wipes liquid adhering to the liquid ejecting portion;

a first cleaner which cleans the wiper; and a second cleaner which cleans the first cleaner to which the liquid adheres during cleaning, wherein the first cleaner has a scraping surface for scraping off the attached material on the wiper, wherein the first cleaner and the second cleaner relatively move in a state where the second cleaner is in contact with the scraping surface.

11. A maintenance method comprising:

wiping attached material on a target object, using a wiper;

cleaning the wiper to which the attached material adheres during wiping, using a first cleaner;

cleaning a scraping surface to which the attached material adheres during cleaning; and moving the first cleaner and a second cleaner relatively in a state where the second cleaner is in contact with the scraping surface.

* * * * *